US005201997A

United States Patent [19]

Fishter et al.

[11] Patent Number: 5,201,997

[45] Date of Patent: Apr. 13, 1993

[54] CHEMICAL MILLING OF NIOBIUM

[75] Inventors: Robert E. Fishter, Boca Raton; Kenneth C. Long, Stuart; Henry M. Hodgens, II, Jupiter, all of Fla.

[73] Assignee: United Technologies Corporation, Hartford, Conn.

[21] Appl. No.: 816,499

[22] Filed: Dec. 31, 1991

[51] Int. Cl.[5] ..... B44C 1/22; C23F 1/00

[52] U.S. Cl. ..... 156/664; 252/79.3; 252/79.4

[58] Field of Search ..... 156/655, 656, 657, 659.1, 156/662, 664; 252/79.3, 79.4; 505/728, 820

[56] References Cited

U.S. PATENT DOCUMENTS

| | | | |
|---|---|---|---|
| 3,844,859 | 10/1974 | Roni | 156/18 |
| 4,080,226 | 3/1978 | Suzuki | 148/20.3 |
| 4,243,476 | 1/1981 | Ahn | 156/643 |
| 4,950,359 | 8/1990 | Parissis | 156/627 |

*Primary Examiner*—William A. Powell

*Attorney, Agent, or Firm*—Robert J. Parizek

[57] ABSTRACT

A solution is described for the chemical milling of niobium and niobium-base alloys. The solution contains about 25% $HNO_3$, about 19% HF, balance $H_2O$, with additions of citric acid and ammonium formate to control the reaction rate and provide a smooth surface finish without intergranular attack, and a small amount of a noble metal to control hydrogen absorption. A process for using the solution to mill niobium alloys is also described.

3 Claims, No Drawings

CHEMICAL MILLING OF NIOBIUM

TECHNICAL FIELD

This invention relates to the chemical milling of niobium and its alloys. The invention also relates to a chemical milling solution for milling niobium and its alloys.

BACKGROUND ART

Niobium alloys are useful in the space related industries because of their high strength to weight ratios at elevated temperatures. Certain alloys have been found to retain useful mechanical properties to temperatures as high as 2800° F.

The benefits of achieving minimum weight in aircraft components are so significant that extreme techniques are frequently employed to achieve complex geometries and to reduce section thicknesses of components to the absolute minimum dimension permissible by design standards.

Usually, components which are fabricated from sheet or plate material of uniform thickness will have excess material in low stress regions. However, in the interest of saving weight, components are generally fabricated so that material which is not required for load support in a structure is removed.

Conventional mechanical machining techniques, such as milling, are often used to remove material, but these techniques are labor intensive, and generally require expensive machinery which must be operated by highly skilled personnel.

Nonmechanical procedures can be used for the removal of niobium in designated areas. For example, Ahn et al, in U.S. Pat. No. 4,243,476, describe a process in which an ion beam is directed toward a solid source of reactive gas species which are given off when the source is hit by the ion beam. The gases then strike the surface of the object to be etched and react with metal atoms to form volatile compounds, and remove metal from the surface of the object. This technique has been found effective for etching the surface of materials containing niobium. However, the low etch rate available when using an ion beam source and the need to perform the operation in vacuum limit the applicability of this technique.

Parissis et al, in U.S. Pat. No. 4,950,359, disclose the removal of a niobium containing coating from a copper substrate by dissolving the coating in an aqueous solution of hydrogen peroxide and an alkaline metal hydroxide. Hydrofluoric acid is commonly used in solutions selected to etch niobium alloys in order to obtain suitable etch rates. However, this solution composition was formulated without hydrofluoric acid to avoid damage to the copper substrate.

DISCLOSURE OF THE INVENTION

The present invention provides a solution for the chemical milling of niobium and niobium alloys so as to provide a sufficiently high rate of attack combined with an acceptable surface finish while avoiding intergranular attack and hydrogen embrittlement. The invention also provides a process for chemical milling of niobium and niobium alloys without intergranular attack and hydrogen embrittlement.

The chemical milling solution is an aqueous solution containing nitric acid and hydrofluoric acid, which attack the surface of the object being chemically milled, citric acid and ammonium formate, which establish the rate of attack and assure a smooth, chemically milled surface without intergranular attack, and a small, but effective, amount of a metal chosen from the group consisting of Cu, Ru, Rh, Pd, Os, Ir, Pt and Au and combinations thereof, which reduces absorption of hydrogen. This group of metals was shown to behave similarly in preventing hydrogen embrittlement during chemical milling of titanium alloys in a previously filed application, Ser. No. 07/637,905, filed on Jan. 7, 1991, now U.S. Pat. No. 5,102,499 entitled "Chemical Milling Solution For Reduced Hydrogen Absorption" which has common inventors and a common assignee, and is incorporated herein by reference.

The method for the chemical milling of niobium includes immersing the niobium article in the aforementioned chemical milling solution at a temperature between about 60° F. and 80° F. for a time sufficient to remove the desired amount of metal.

The foregoing and other features and advantages of the present invention will become more apparent from the following description.

BEST MODE FOR CARRYING OUT THE INVENTION

An aqueous solution containing about 40% by volume nitric acid (70% by weight) and about 2% by volume hydrofluoric acid (48% by weight) was initially tried and found to be capable of removing material from the surface of a niobium base alloy containing about ten weight percent hafnium and one weight percent titanium. However, visual observation indicated that the rate of removal was much lower than considered acceptable, and the surface finish was unacceptably rough.

A chemical milling solution developed for the removal of titanium alloys, containing nominally 40% by volume nitric acid and 40% by volume hydrofluoric acid with additions of citric acid, ammonium formate and a precious metal, was then evaluated. This solution is described in the previously filed application, Ser. No. 07/637,905, referred to above. This solution, used at about 110° F., proved to have an uncontrollably high reaction rate. Conducting the reaction at room temperature did not lower the reaction rate enough to provide a reliably controllable reaction rate.

Additional experimentation with solution composition and operating temperature indicated that an acceptable solution contained about 24 to 30 volume percent nitric acid, 17 to 22 volume percent hydrofluoric acid, 2 to 2.6 grams per liter ammonium formate, 6 to 8 grams per liter citric acid, and 0.02 to 0.20 millimoles palladium/liter of etch solution. The reactivity of this solution was found to be satisfactory for chemical milling niobium alloys when the milling operation was conducted between about 60° and 80° F. which is approximately room temperature. The present invention may be better understood through reference to the following illustrative example.

EXAMPLE 1

A flat rectangular sample of a niobium alloy containing 10% hafnium and 1% titanium was immersed in a solution containing 26% by volume nitric acid, 19% by volume hydrofluoric acid, 7 g/l citric acid, 2.3 g/l ammonium formate, and 0.12 millimoles per liter dissolved palladium at room temperature. The sample was 0.062"

thick and was masked so that only one side was exposed to the acid solution. Material was removed from the surface of the sample at a rate of about 0.016" per hour, and the thickness was reduced uniformly to 0.016–0.018". The surface finish of the chemically milled sample was acceptably smooth. There was no metallographic evidence of intergranular attack of the niobium alloy and there was no measurable hydrogen absorption by the alloy.

Although this invention has been shown and described with respect to detailed embodiments thereof, it will be understood by those skilled in the art that various changes in form and detail thereof may be made without departing from the spirit and scope of the invention.

We claim:

1. An aqueous acid solution for chemically milling niobium and niobium alloys comprising, in percent by weight, 24–30% $HNO_3$ (70% by weight), 17–22% HF (48% by weight), balance $H_2O$ to which is added 6–8 grams/liter citric acid, 2–3 grams/liter ammonium formate, and 0.02–0.20 millimoles/liter of a metal chosen from the group consisting of Cu, Ru, Rh, Pd, Os, Ir, Pt and Au and combinations thereof.

2. An aqueous acid solution for chemically milling niobium and niobium alloys comprising, in percent by weight, 25–27% $HNO_3$ (70% by weight), 18–20% HF (48% by weight), about 7 grams/liter citric acid, about 2.3 grams/liter ammonium formate and about 0.12 millimoles/liter of metal chosen from the group consisting of Cu, Ru, Rh, Pd, Os, Ir, Pt and Au and combinations thereof.

3. A method of chemically milling niobium metal which is susceptible to embrittlement by hydrogen whereby a surface of said metal is contacted by the chemical milling solution as recited in claim 1 at a temperature between about 60° F. and 80° F. for a time sufficient to remove the desired amount of metal.

* * * * *